US011761640B2

(12) United States Patent
Chirumbolo

(10) Patent No.: US 11,761,640 B2
(45) Date of Patent: Sep. 19, 2023

(54) DOOR-LOCKING DEVICE FOR SELF-CLEANING HOUSEHOLD OVENS

(71) Applicant: Illinois Tool Works Inc., Glenview, IL (US)

(72) Inventor: Dino Chirumbolo, Settimo Torinese (IT)

(73) Assignee: Illinois Tool Works Inc., Glenview, IL (US)

( * ) Notice: Subject to any disclaimer, the term of this patent is extended or adjusted under 35 U.S.C. 154(b) by 507 days.

(21) Appl. No.: 15/522,353

(22) PCT Filed: Dec. 2, 2015

(86) PCT No.: PCT/US2015/063419
§ 371 (c)(1),
(2) Date: Apr. 27, 2017

(87) PCT Pub. No.: WO2016/099886
PCT Pub. Date: Jun. 23, 2016

(65) Prior Publication Data

US 2017/0328576 A1 Nov. 16, 2017

(30) Foreign Application Priority Data

Dec. 15, 2014 (IT) ..... TO2014A001041

(51) Int. Cl.
*F24C 15/02* (2006.01)
*F24C 14/02* (2006.01)
(Continued)

(52) U.S. Cl.
CPC ..... *F24C 15/022* (2013.01); *E05C 3/00* (2013.01); *F23M 7/00* (2013.01); *F24C 14/02* (2013.01);
(Continued)

(58) Field of Classification Search
CPC ..... E05B 47/00
See application file for complete search history.

(56) References Cited

U.S. PATENT DOCUMENTS 1,213,651 A * 1/1917 Johns ..... E05C 19/022 292/99
2,417,521 A * 3/1947 Reeves ..... F24C 15/022 126/198
(Continued)

FOREIGN PATENT DOCUMENTS

EP 1640493 3/2006
WO WO 2006/123220 11/2006
(Continued)

OTHER PUBLICATIONS

International Search Report and Written Opinion for PCT/US2015/063419.

*Primary Examiner* — Edelmira Bosques
*Assistant Examiner* — Deepak A Deean
(74) *Attorney, Agent, or Firm* — The Small Patent Law Group LLC; Joseph M. Butscher

(57) ABSTRACT

A door-locking device for a self-cleaning oven includes a support configured to be fixed to a frame of the oven. A main slider is movable relative to the support along a longitudinal rectilinear direction, and is configured to be pushed elastically towards an extracted position and pushed by the door of the oven towards a retracted position. A locking arm is coupled to the support around an articulation axis perpendicular to the longitudinal rectilinear direction and oscillates around the articulation axis between an unlocked position and a locked position. A transmission mechanism connects the locking arm to the main slider and is arranged to swing the locking arm from the unlocked position to the locked position and vice versa via movement of the main slider from the extracted position to the retracted position, and vice
(Continued)

versa. An electromagnetic switch includes an electromagnet that drives a movable member associated with a locking pin arranged to lock the main slider in the retracted position.

15 Claims, 9 Drawing Sheets

(51) Int. Cl.
*E05C 3/00* (2006.01)
*F23M 7/00* (2006.01)
*E05B 47/00* (2006.01)
*E05C 7/00* (2006.01)

(52) U.S. Cl.
CPC ..... *F24C 15/02* (2013.01); *E05B 47/00* (2013.01); *E05C 7/00* (2013.01)

(56) References Cited

U.S. PATENT DOCUMENTS 2,520,816 A * 8/1950 Sherman ..... F24C 15/022 126/41 D
3,125,365 A * 3/1964 Eigelbach ..... F24C 14/02 292/7
3,387,874 A * 6/1968 Holtkamp ..... C07D 307/73 292/201
3,410,988 A * 11/1968 Nagel ..... F24C 14/02 219/412
3,416,515 A * 12/1968 Mertler ..... F23M 7/00 126/273 R
3,438,666 A * 4/1969 Erickson ..... F24C 15/022 292/210
3,912,904 A * 10/1975 Phifer ..... F24C 15/022 219/413
3,968,983 A * 7/1976 Heit ..... F24C 15/022 292/201
4,006,121 A * 2/1977 Isono ..... E05C 19/024 200/61.64
4,374,320 A * 2/1983 Barnett ..... F24C 15/022 126/197
4,457,545 A * 7/1984 Wilson ..... H05B 6/6417 292/29
4,593,945 A * 6/1986 Arute ..... F24C 15/022 292/201
4,638,137 A * 1/1987 Kazumi ..... H05B 6/6417 219/721
4,826,224 A * 5/1989 Lee ..... F24C 15/022 292/25
4,838,586 A * 6/1989 Henne ..... F24C 15/022 292/113
4,875,721 A * 10/1989 Okamoto ..... E05C 9/02 292/29
4,927,996 A * 5/1990 Genbauffe ..... F24C 15/022 126/197
5,004,276 A * 4/1991 Hanley ..... E05C 19/022 292/126
5,072,974 A * 12/1991 Henne ..... E05C 19/022 292/126
5,493,099 A * 2/1996 McWilliams, III ..... E05B 51/02 126/197
5,879,036 A * 3/1999 Moline ..... D06F 37/42 292/210
6,213,525 B1 * 4/2001 Nicola ..... B60N 2/01583 248/503.1
6,315,336 B1 * 11/2001 Swartzell ..... E05B 47/0012 292/201
6,698,418 B2 * 3/2004 Ramsey ..... F24C 15/022 126/19 R
6,886,868 B2 * 5/2005 Hengelein ..... D06F 37/42 292/201
6,930,284 B2 * 8/2005 Kang ..... F24C 15/022 126/197
7,040,674 B2 * 5/2006 Lomicka ..... E05B 47/0012 292/201
7,481,469 B2 * 1/2009 Harrer ..... F24C 15/022 292/201
8,109,543 B2 * 2/2012 Chirumbolo ..... E05B 15/101 126/197
9,587,837 B2 * 3/2017 Colucci ..... E05B 15/0046
2004/0169031 A1 * 9/2004 Kang ..... F24C 15/022 219/391
2005/0133502 A1 * 6/2005 Cho ..... F24C 15/022 219/739
2005/0173932 A1 * 8/2005 Lomicka ..... E05B 47/0012 292/201
2007/0241568 A1 * 10/2007 Harrer ..... F24C 15/022 292/144
2008/0078373 A1 * 4/2008 Kim ..... F24C 15/022 126/192
2008/0196707 A1 * 8/2008 Chirumbolo ..... E05B 15/101 126/197
2018/0087778 A1 * 3/2018 Ivanovic ..... F24C 14/02

FOREIGN PATENT DOCUMENTS

WO WO 2010/041210 4/2010
WO WO 2012/012408 1/2012

* cited by examiner 62
82
46
84
80
76
78
24
56
12
70
38
58
40
44
22

14
10
42
B
94
20a
30
26
28
96
34
36
98
A 62
82
46
84
80
76
78
24
56
12
70
38
58
40
44
22

14
10
42
B
94
20a
30
26
28
96
34
36
98
A

DOOR-LOCKING DEVICE FOR SELF-CLEANING HOUSEHOLD OVENS

RELATED APPLICATIONS

This application is a National Phase of International Application No. PCT/US2015/063419, filed Dec. 2, 2015, which relates to and claims priority benefits from Italian Application No. TO2014A001041, filed Dec. 15, 2014, both of which are hereby incorporated by reference in their entireties.

FIELD OF THE INVENTION

The present invention relates to components for household ovens and concerns a door-locking device for self-cleaning household ovens.

DESCRIPTION OF THE PRIOR ART

Self-cleaning household ovens or pyrolytic ovens are equipped with an automatic cleaning function during which the temperature inside the oven reaches around 500° so as to burn off the particles of dirt and grease deposited on the inner walls of the oven. Self-cleaning ovens are equipped with a door-locking device which prevents the door from being opened during the automatic cleaning function, to ensure that the cleaning process takes place in total safety.

The door-locking devices currently in production have the disadvantage of a complex structure. Usually there are multiple springs to implement various movements. Furthermore, the door-locking devices currently used require at least one separate microswitch to detect the position of the door.

SCOPE AND SUMMARY OF THE INVENTION

The present invention aims to provide a door-locking device which is simpler and has a smaller number of components and which does not require an external microswitch to detect the position of the door.

According to the present invention, this aim is achieved by a door-locking device having the features forming the subject matter of claim 1.

The claims are an integral part of the teaching of the invention.

BRIEF DESCRIPTION OF THE DRAWINGS

The present invention will now be described in detail with reference to the accompanying drawings, provided purely by way of non-limiting example, in which.

DETAILED DESCRIPTION

Figure 1:
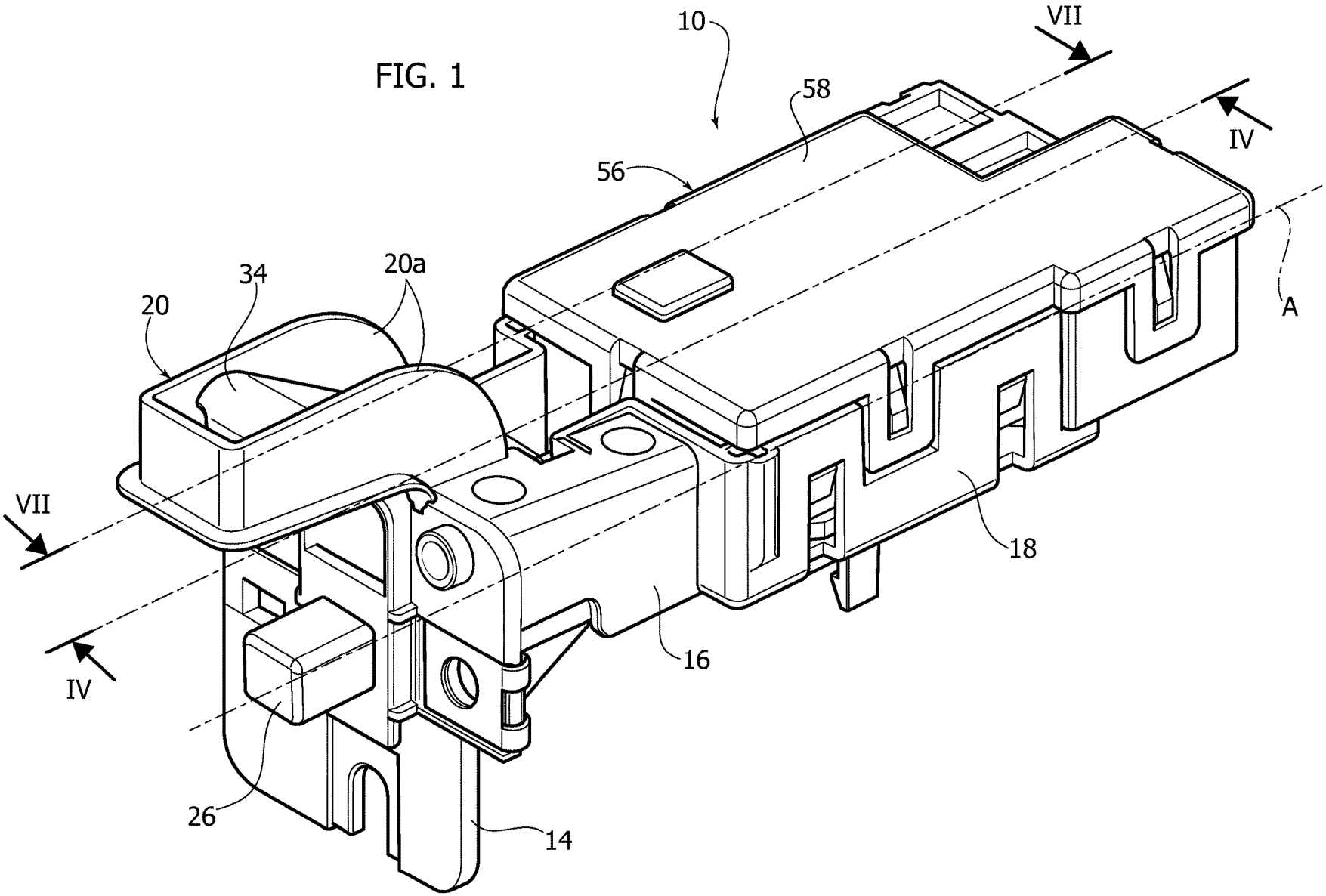
FIG. 1 is a perspective view of a door-locking device according to the present invention.
Figure 2:
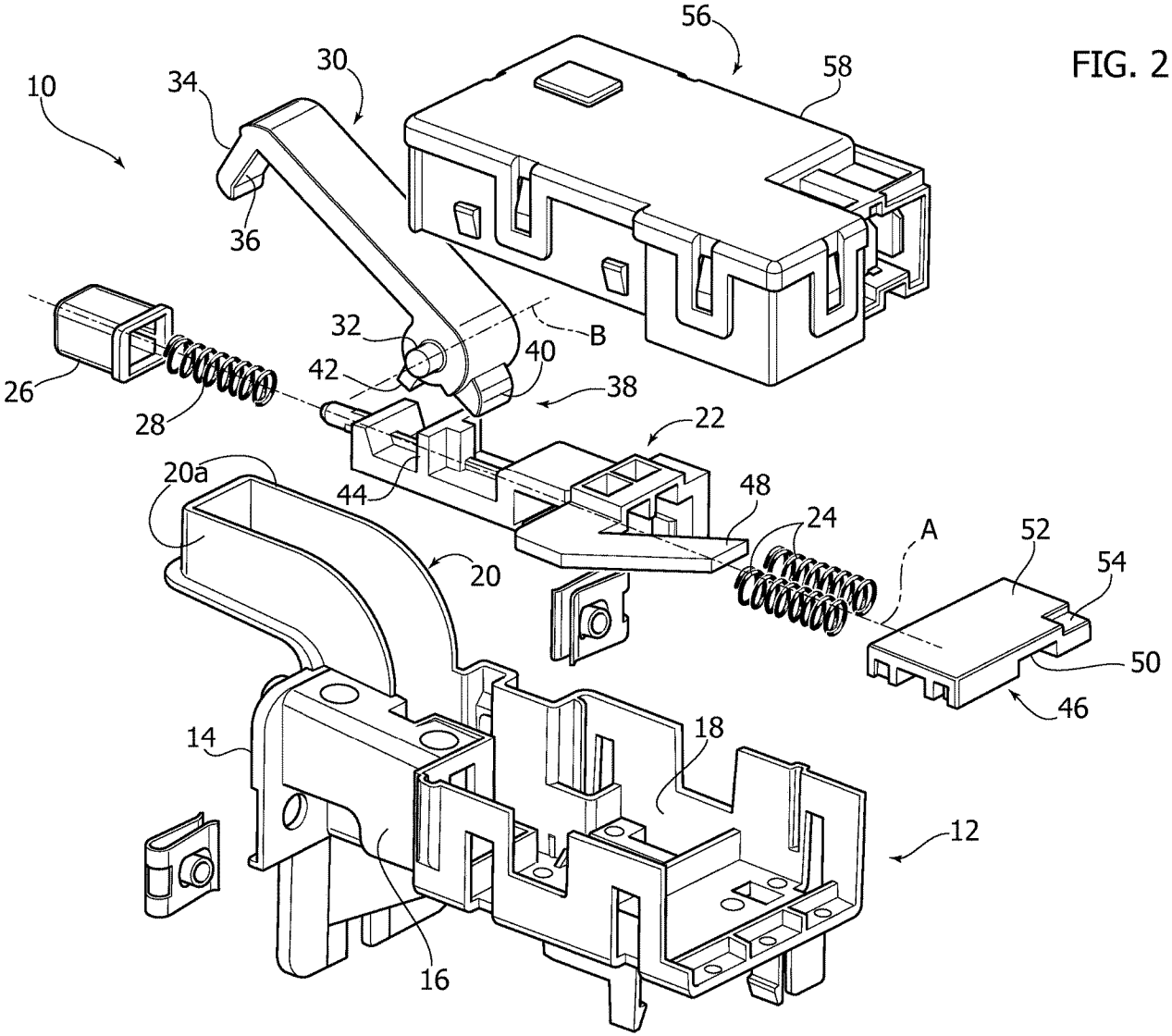
FIG. 2 is an exploded perspective view of the door-locking device of FIG. 1.

With reference to FIGS. 1 and 2, reference sign 10 indicates a door-locking device according to the present invention. The door-locking device 10 comprises a support 12 designed to be fixed to the frame of a household oven. The support 12 comprises a front wall 14, an articulation portion and a rear seat 18 which is open towards the top. The support 12 also comprises an upper protective piece 20 which extends upwards from the articulation portion 16. The upper protective piece 20 comprises two parallel walls 20*a* spaced apart in a transverse direction.

With reference to FIG. 2, the door-locking device 10 includes a main slider 22 movable relative to the support 12 along a longitudinal direction A between an extracted position and a retracted position. The main slider 22 is pushed elastically towards the extracted position by first elastic means, formed for example by a pair of helical springs in compression 24 arranged in parallel between the support 12 and the main slider 22. Preferably, the door-locking device 10 comprises a button 26 which extends through an opening in the front wall 14 and is movable in the longitudinal direction A independently of the main slider 22. An elastic element 28, formed for example by a helical spring in compression, is arranged between the main slider 22 and the button 26. The spring 28 is stiffer than the springs 24.

The door-locking device 10 comprises a locking arm 30 articulated to the articulation portion 16 of the support 12 around a transverse axis B. The locking arm 30 has, at a first end, an articulation pin 32 which rotatably engages with the articulation portion 16 of the support 12 so as to allow the locking arm 30 to oscillate around the axis B between an unlocked position and a locked position. The locking arm 30 has a second end 34 in the shape of an L, opposite to the articulation pin 32. The L-shaped end 34 has a stop surface 36 preferably having transverse grooves.

The main slider 22 and the locking arm 30 interact with each other by means of a transmission mechanism 38 which imparts to the locking arm 30 an oscillating movement about the axis B following a movement of the main slider 22 in the rectilinear direction A. The transmission mechanism 38 includes projecting contact formations 40, 42, 44 integrally formed with the main slider 22 and with the locking arm 30, arranged in mutual contact so as to cause the locking arm 30 to oscillate as a result of the rectilinear movement of the main slider 22. In the example shown, the transmission mechanism 38 comprises a first and a second radial appendage 40, 42 projecting from the first end of the locking arm 30 in a radial direction with respect to the axis B, and an actuating appendage 44 projecting from the main slider 22 in the direction perpendicular to the axis A. The transmission mechanism 38 is ideally similar to a rack and pinion gear, in which the actuating appendage 44 of the main slider 22 is ideally similar to a tooth of a rack and the two radial appendages 40, 42 of the locking arm 30 are ideally similar to two teeth of a gear wheel. The actuating appendage 44 engages with the free space between the two radial appendages 40, 42, in a similar way to the tooth of a rack which engages with the empty space between two adjacent teeth of a gear wheel in a rack and pinion mechanism.

Again with reference to FIG. 2, the door-locking device comprises an auxiliary slider 46 movable relative to the support 12 in a direction transverse to the longitudinal direction A. The auxiliary slider 46 interacts with a cam 48 of the main slider 22. The cam 48 engages with a seat 50 of the auxiliary slider 46 and has surfaces which are inclined with respect to the longitudinal direction A, so that the movement in the direction A of the main slider 22 causes, thanks to the contact between the cam 48 and the seat 50, a movement of the auxiliary slider 46 in a direction transverse to the axis A. In particular, when the main slider 22 is in the extracted position, the auxiliary slider 46 is located in a first position indicating that the door is open and when the main slider 22 is in the retracted position the auxiliary slider 46 is in a second position indicating that the door is closed. The auxiliary slider 46 has a top surface 52 with a recessed portion 54.

The door-locking device 10 comprises an electromagnetic switch 56 which is secured in the rear seat 18 of the support 12. The electromagnetic switch 56 may be constructed as described in Italian patent No 1411945 owned by the Applicant. The electromagnetic switch described in Italian patent 1411945 is designed to be used in a door-locking device for washing machines. The same device already used for door-locking devices for washing machines may advantageously be used in the door-locking device 10 according to the present invention without the need for any structural changes.

Figure 7:
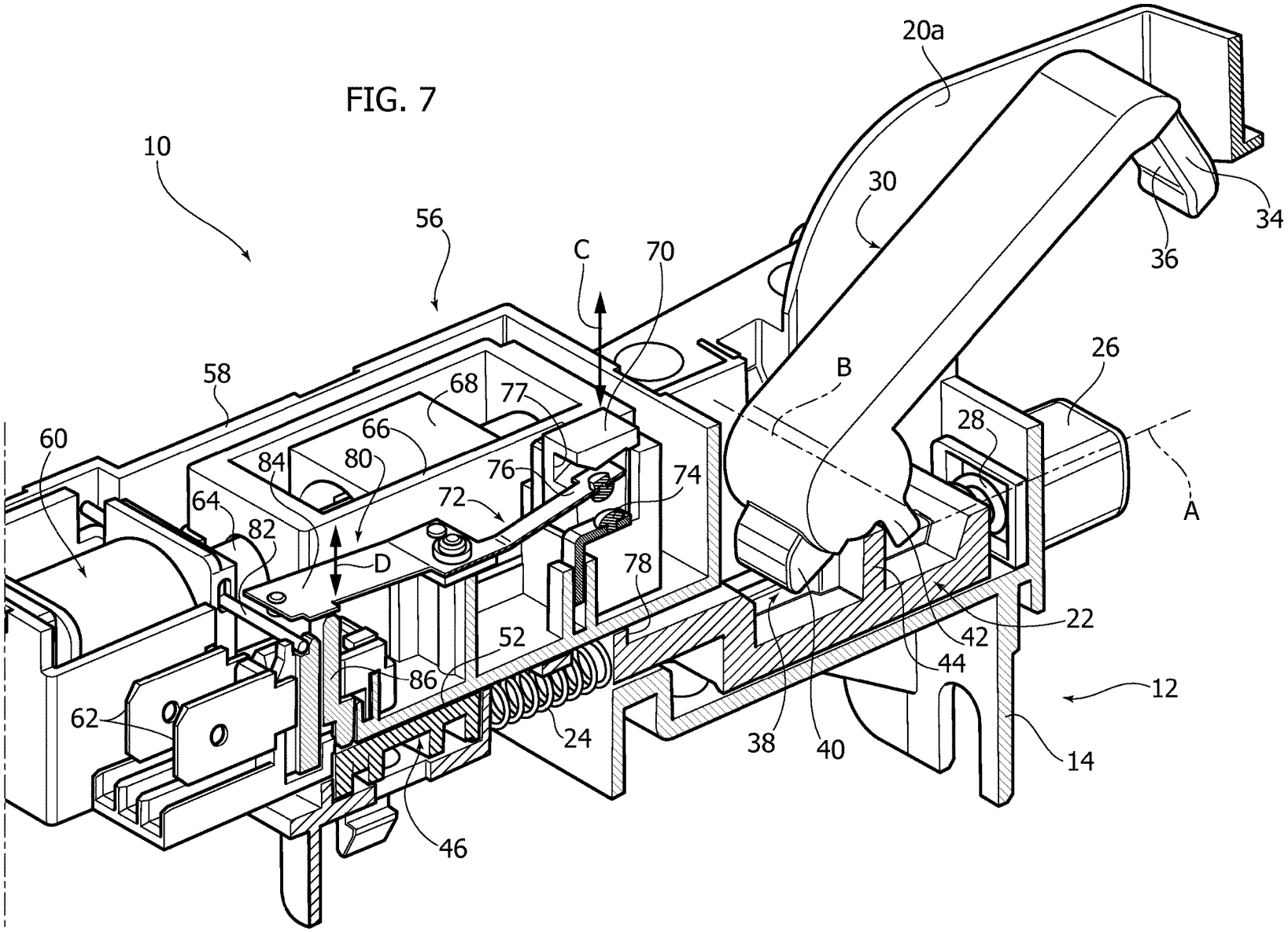
FIGS. 7, 8 and 9 are sections along the line VII-VII of FIG. 1 showing the device in the positions of door open, door closed and door locked.
Figure 8:
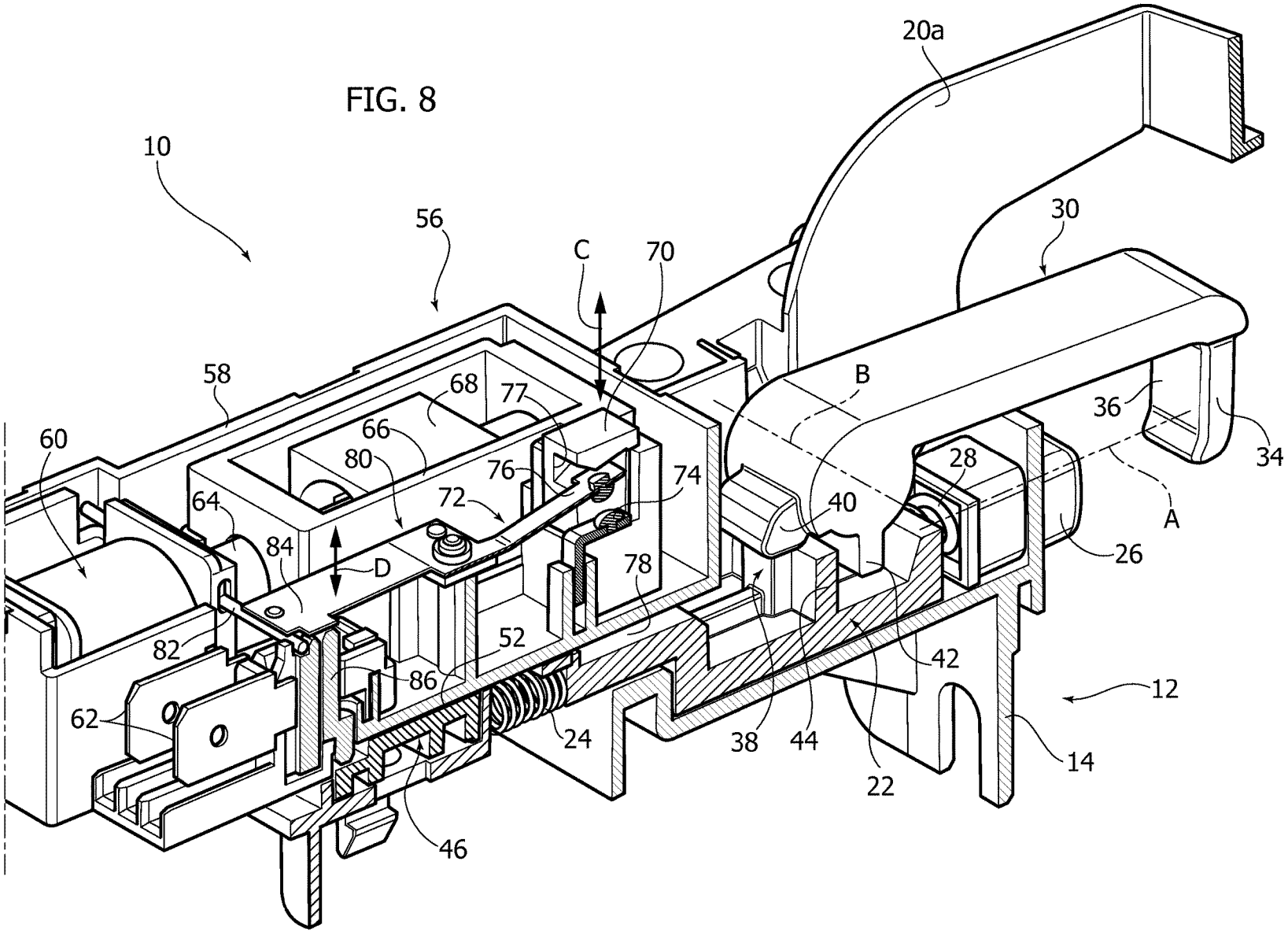
Figure 9:
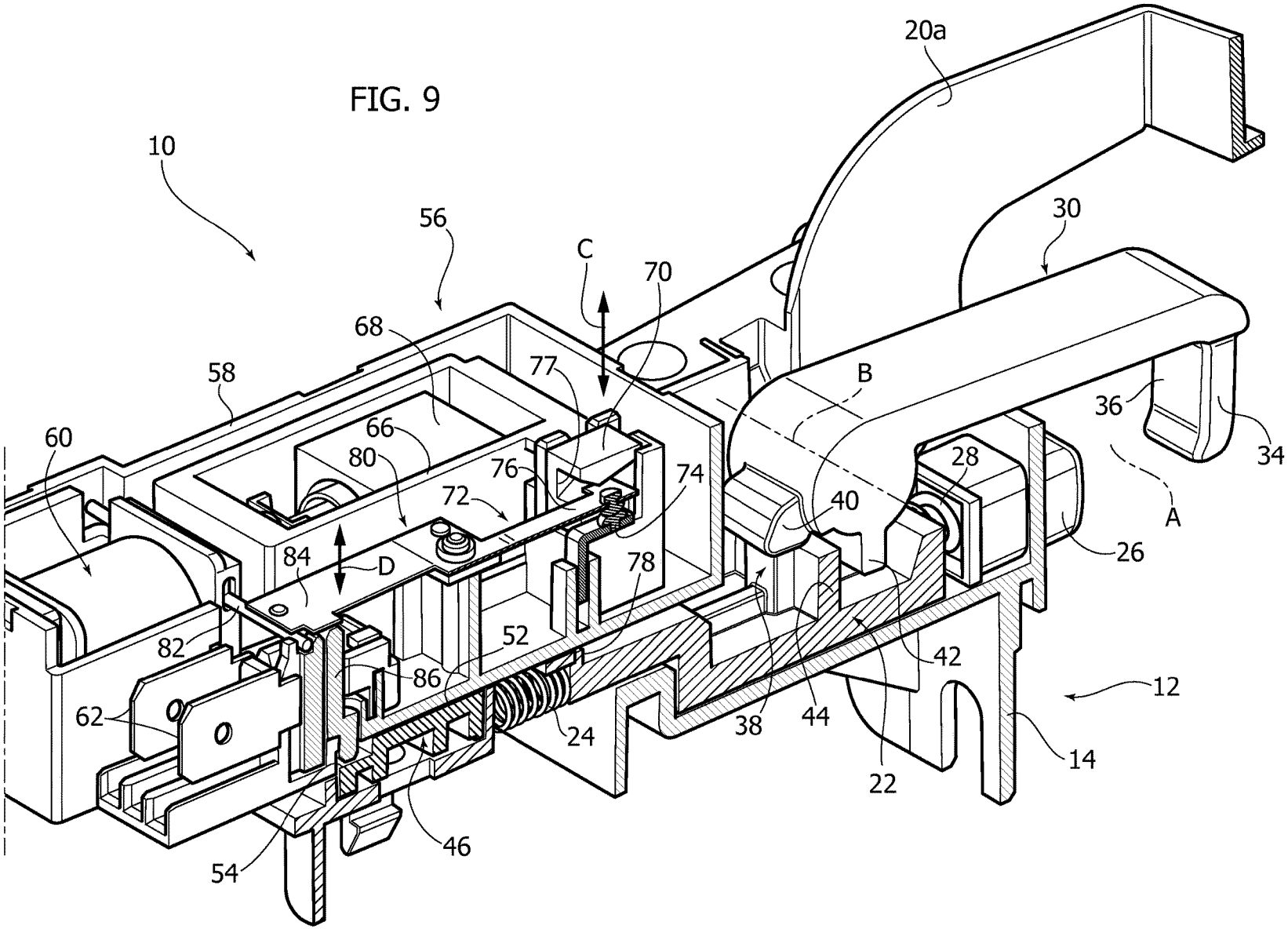

With reference to FIGS. 7 to 9, the electromagnetic switch 56 comprises a casing 58 in which is housed an electromagnet 60 powered by a pair of terminals 62. The electromagnet 60 comprises a magnetic core 64 secured to a movable frame 66 which interacts with a bistable retaining mechanism 68. The movable frame 66 can move between two stable positions in a rectilinear direction parallel to the longitudinal direction A. The electromagnetic switch 56 comprises a locking pin 70 movable in the direction indicated by the double arrow C between an unlocked position and a locked position. The locking pin 70 is connected to the movable frame 66 by cam surfaces that operate the locking pin in the direction C following the movement of the movable frame 66 in the direction A. The electromagnetic switch 56 includes a door lock switch 72 switchable between an open position corresponding to the unlocked position of the pin 70 and a closed position corresponding to the locked position of the pin 70. The door lock switch 72 comprises a fixed contact 74 and a movable contact formed by an elastic plate 76. The elastic plate 76 engages with a seat 77 of the locking pin 70, whereby the movement of the locking pin 70 in the direction C between the unlocked position and the locked position switches the door lock switch 72 between the open position and the closed position, and vice versa. The locking pin 70 in the locked position interacts with a step 78 of the main slider 22, preventing the main slider 22 from moving from the retracted position into the extracted position.

The electromagnetic switch 56 further comprises a door-sensing switch 80 including a fixed contact 82 and a movable contact formed by an elastic plate 84. The door-sensing switch 80 comprises a door-sensing pin 86 movable in the direction D and having an upper end in contact with the elastic plate 84 and a lower end in contact with the top surface 52 of the auxiliary slider 46. When the auxiliary slider 46 is in the position corresponding to the extracted position of the main slider 22 (door open position), the door-sensing pin 86 rests on the top surface 52 of the auxiliary slider 46 and keeps the door-sensing switch 80 in the open position. When the auxiliary slider 46 is in the position corresponding to the retracted position of the main slider 22 (door closed position), the door-sensing pin 86 engages with the recessed portion 54 of the auxiliary slider 46 and the plate 84, under effect of its own elasticity, comes into contact with the fixed contact 82 and closes the door-sensing switch 80.

Figure 3:
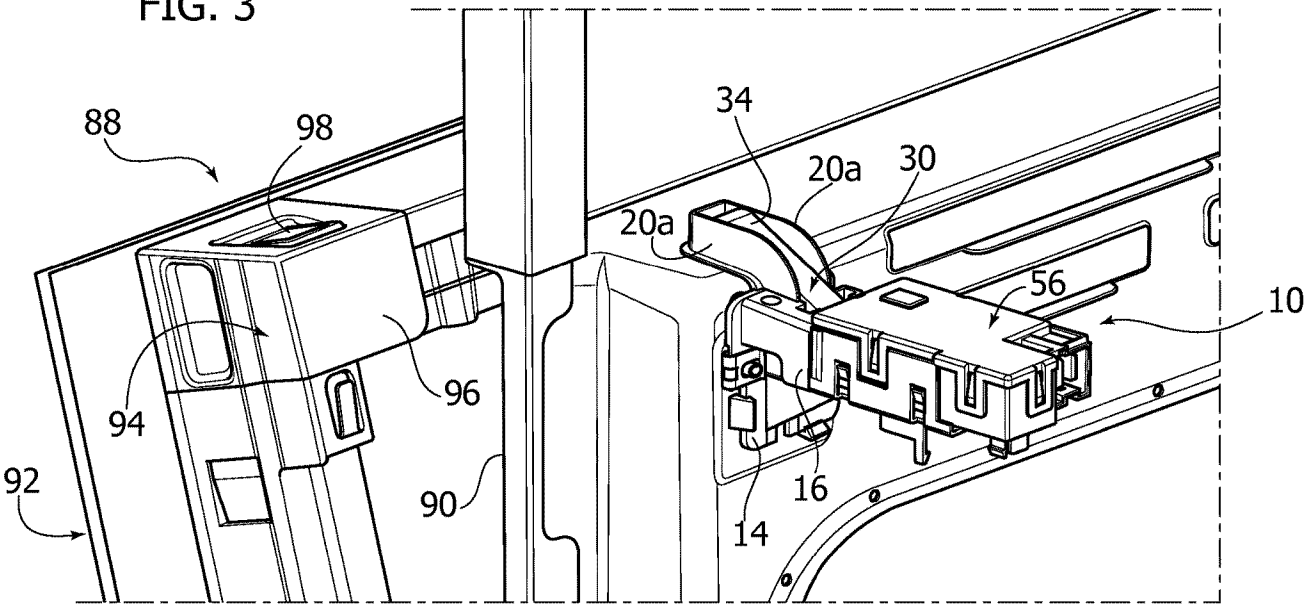
FIG. 3 is a perspective view showing the door-locking device of FIG. 1 mounted on a household oven.
Figure 3A:
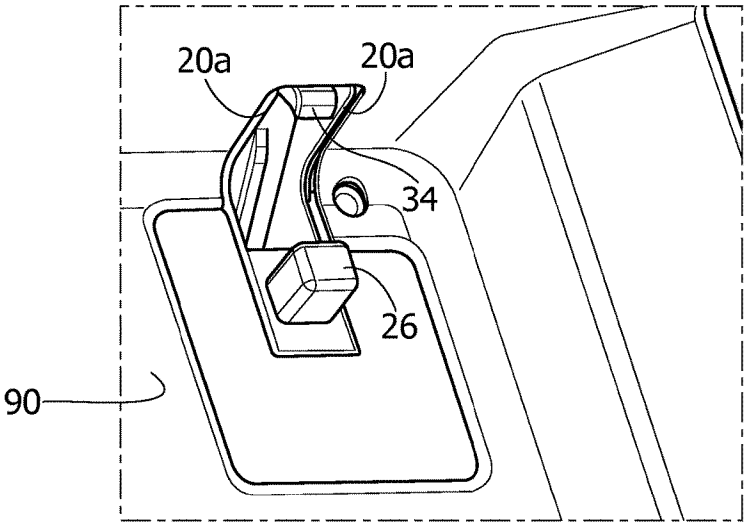
FIG. 3*a* is a perspective view of the front part of the oven of FIG. 3, FIGS. 4, 5 and 6 are sections along the line IV-IV of FIG. 1 showing the device in the positions of door open, door closed and door locked.

FIGS. 3 and 3*a* show the door-locking device 10 according to the present invention mounted on a household oven 88 including a front frame 90 and a door 92. The door 92 is articulated to the front frame 90 around a lower horizontal axis. The door-locking device 10 is secured to the rear side of the front frame 90. As can be seen in FIG. 3*a*, the button 26 and the L-shaped end 34 of the locking arm 30 protrude from the front side of the front frame 90. The door 92 has a locking member 94 with a support surface 96 and a hole 98. The support surface 96 is designed to press against the button 26 of the door-locking device 10. The hole 98 is designed to receive the L-shaped end 34 of the locking arm 30.

Figure 4:
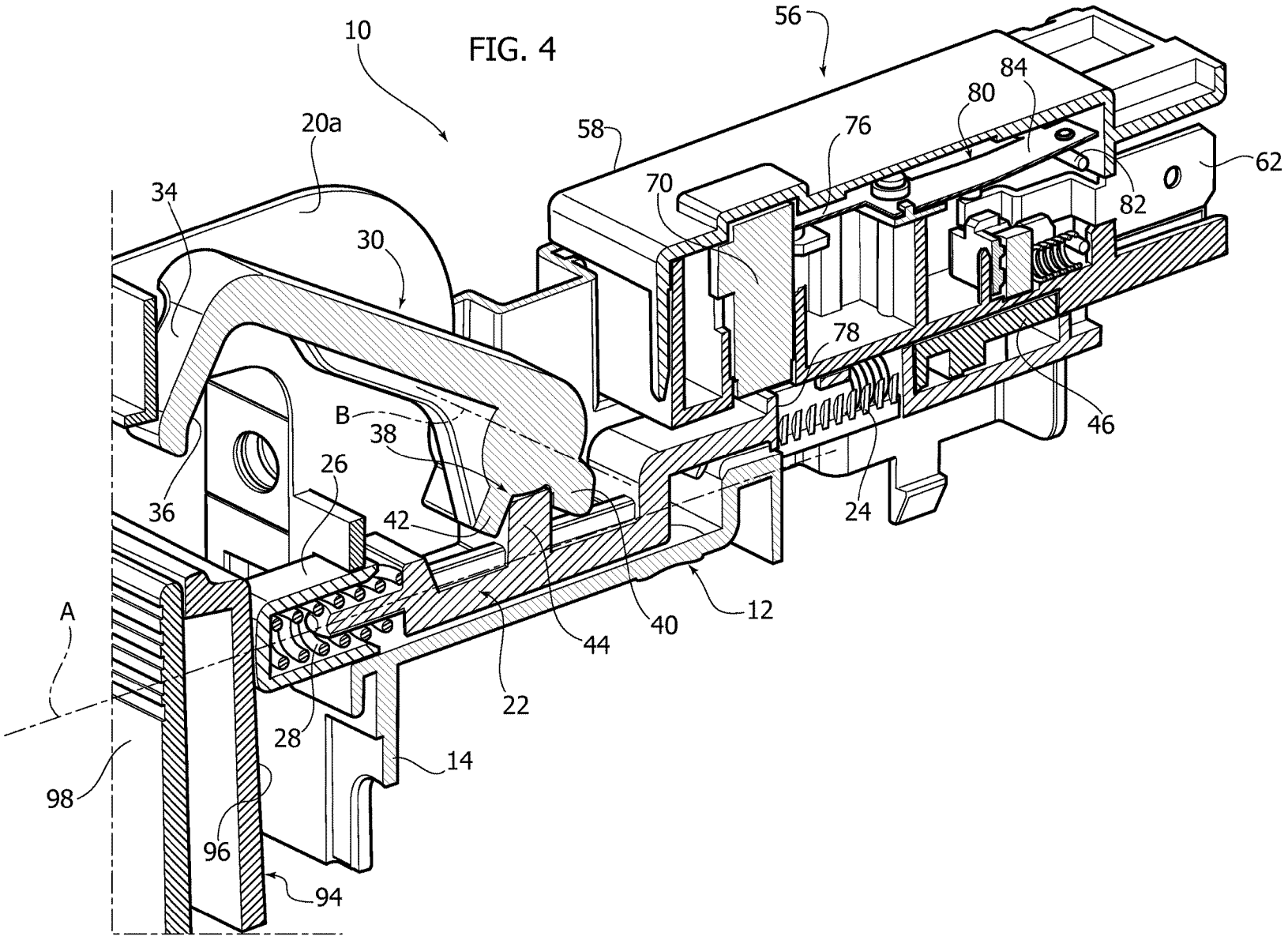

FIGS. 4 and 7 show the door-locking device 10 according to the present invention in a door open condition. In this condition, the main slider 22 is pushed by the springs 24 into the extracted position. In this condition, the locking arm 30 is in the unlocked position in which the L-shaped end 34 is raised and is located between the walls 20*a* of the upper protective piece 20. The button 26 protrudes from the front side of the front frame 90 of the oven (FIG. 3*a*). In the door open position, the auxiliary slider 46 is in the first position. The door-sensing switch 80 is open, preventing the supply of power to the electromagnet 60. The locking pin 70 is in the unlocked position and the door lock switch 72 is open.

When the door 92 is closed, the surface 96 of the locking member 94 of the door 92 presses against the button 26 and pushes the button 26 towards the inside of the front frame 90. Since the spring 28 arranged between the main slider 22 and the button 26 is stiffer than the springs 24 arranged between the support 12 and the main slider 22, the inward movement of the button 26 moves the main slider 22 from the extracted position into the retracted position. The button 26 and the associated spring 28 prevent the door-locking device 10 from being damaged in the event that the door 92 is slammed against the front frame 90. As the main slider 22 moves from the extracted position into the retracted position, the actuating appendage 44 of the main slider 22 pushes against the first radial appendage 40 of the locking arm 30, causing the locking arm 30 to oscillate from the unlocked position of FIGS. 4 and 7 into the locked position of FIGS. 5 and 8.

When the locking arm 30 rotates into the locked position, the L-shaped end 34 is inserted into the hole 98 in the locking member 94 of the door 92. The surface 36 of the L-shaped end 34 faces a wall of the hole 98 and locks the door 92 in the closed position.

Figure 5:
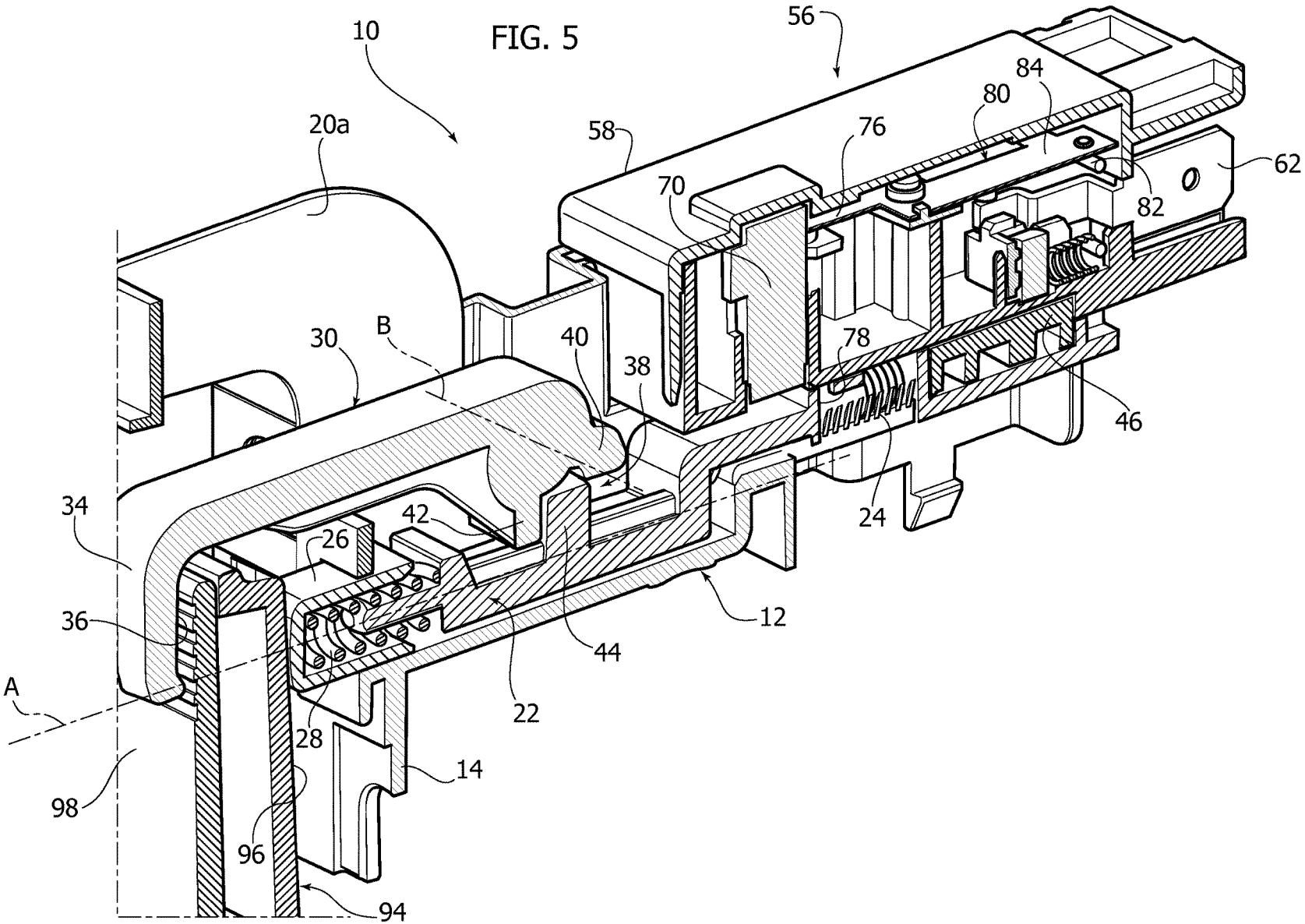

When the main slider 22 is in the retracted position, the auxiliary slider 46 is in the position shown in FIG. 8. In this case, the door-sensing pin 86 rests on the recessed portion 54 of the auxiliary slider 46. The door-sensing switch is closed and closes the power supply circuit for the electromagnet 60. FIGS. 5 and 8 show the case in which the door is closed but not yet locked.

Figure 6:
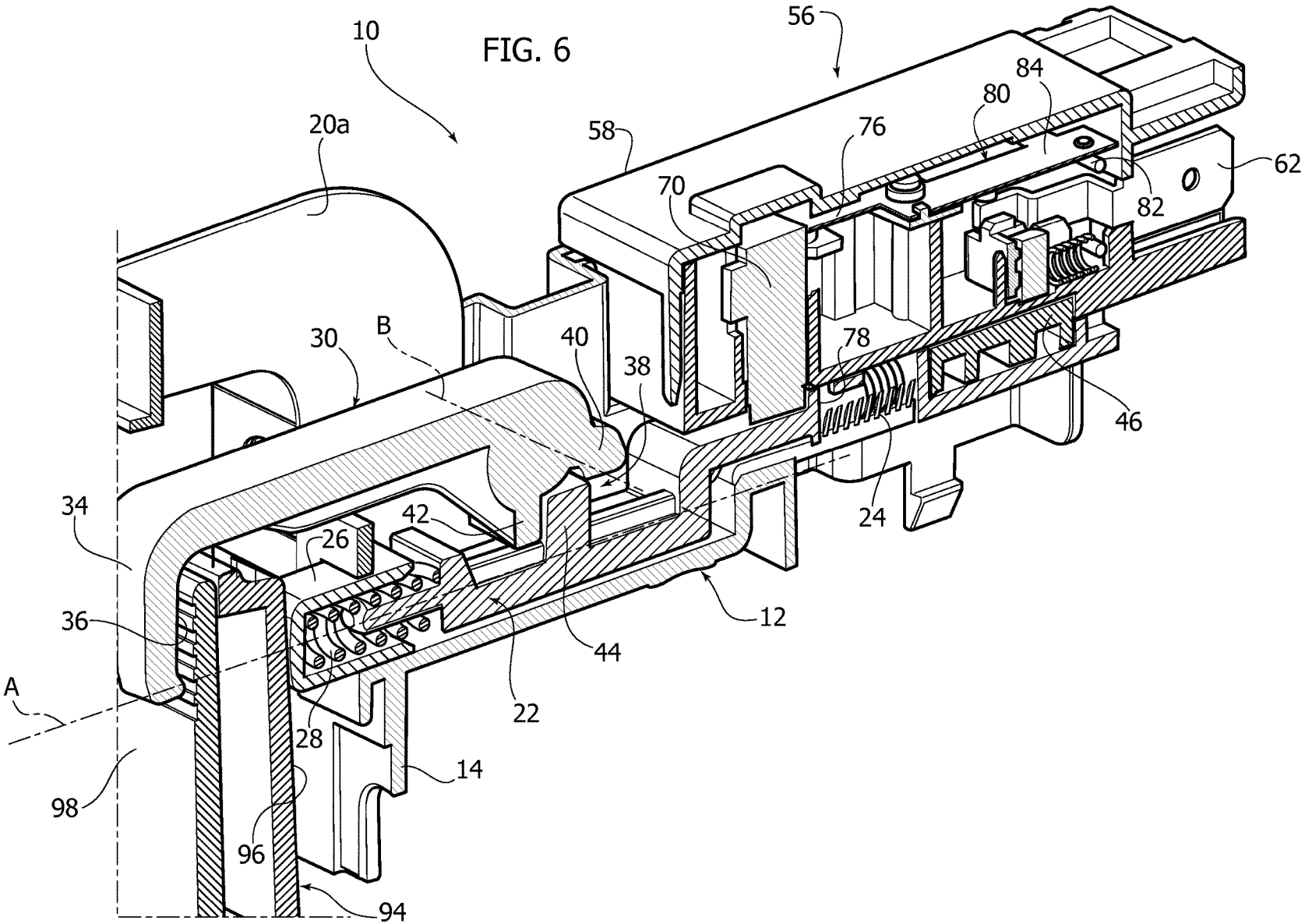

After the door-sensing switch 80 has been closed, the electromagnet 60 may be actuated to lock the door. Once the electromagnet 60 has been actuated, the movable frame 66 moves into the locked position, and pushes the locking pin 70 down. The locking pin 70 moves into the locked position shown in FIGS. 6 and 9. In this position, the locking pin 70 interferes with the step 78 of the main slider 22 and retains the main slider 22 in the retracted position. At the same time, the door lock switch 72 is closed and a "door locked" signal is generated. In this condition, the locking arm 30 is retained in the locked position. Any attempt to open the door 92 cannot rotate the locking arm 30 into an unlocked position because a force on the L-shaped end 34 of the locking arm 30 due to the attempt to open the door 92 would have zero torque around the axis B. Any attempt to open the door 92 would not place stress upon the main slider 22.

From the above description it is apparent that the door-locking device 10 according to the present invention has a particularly simple structure and is composed of a reduced number of components. In particular, the locking arm 30 is not associated with springs or other elastic elements. The only elastic elements required are the springs 24 which push the slider 22 into the extracted position. The spring 28 associated with the button 26 serves solely to provide an additional safety feature that prevents damage in the event of slamming of the door. A particularly advantageous feature of the door-locking device according to the present invention is that an electromagnetic switch 56 already provided for door-locking devices for washing machines may be used without having to be changed in any way. The electromagnetic switch 56 provides "door closed" and "door locked" signals without the need for separate microswitches.

Naturally, without prejudice to the principle of the invention, the structural details and embodiments may be varied widely with respect to those described and illustrated, without thereby departing from the scope of the invention as defined by the claims that follow.

The invention claimed is:

1. A door-locking device for an oven, comprising:

a support configured to be fixed to a frame of the oven;

a main slider movable relative to the support along a longitudinal rectilinear direction, pushed elastically towards an extracted position and configured to be pushed by the door of the oven towards a retracted position;

a button movable independently of the main slider along the longitudinal rectilinear direction with respect to the main slider and an elastic element disposed between the button and the main slider, wherein the elastic element biases the button and the main slider in opposing directions;

a locking arm articulated to the support around an articulation axis perpendicular to the longitudinal rectilinear direction and oscillating around the articulation axis between an unlocked position and a locked position;

a transmission mechanism which connects the locking arm to the main slider and arranged to swing the locking arm from the unlocked position to the locked position and vice versa due to the movement of the main slider from the extracted position to the retracted position, and vice versa; and an electromagnetic switch comprising an electromagnet which drives a movable member associated with a locking pin arranged to lock the main slider in the retracted position.

2. A door-locking device according to claim 1, wherein the transmission mechanism comprises contact formations provided on the locking arm and on the main slider and cooperating with each other for imparting an oscillating movement to the locking arm following a rectilinear movement of the main slider.

3. A door-locking device according to claim 1, wherein the locking arm has one L-shaped end opposite to the articulation axis.

4. A door-locking device according to claim 1, further comprising an auxiliary slider movable along a direction transverse to the longitudinal rectilinear direction and connected to the main slider by a cam, the auxiliary slider cooperating with a door-sensing switch of the electromagnetic switch.

5. A door-locking device according to claim 1, wherein the elastic element is a helical spring in compression, wherein the helical spring is coaxial with a longitudinal rectilinear axis.

6. A door-locking device for an oven, comprising:

a support configured to be fixed to a frame of the oven;

a main slider movable relative to the support along a longitudinal rectilinear direction, pushed elastically towards an extracted position and configured to be pushed by the door of the oven towards a retracted position;

a locking arm articulated to the support around an articulation axis perpendicular to the longitudinal rectilinear direction and oscillating around the articulation axis between an unlocked position and a locked position, wherein the locking arm has one L-shaped end opposite to the articulation axis;

a transmission mechanism which connects the locking arm to the main slider and arranged to swing the locking arm from the unlocked position to the locked position and vice versa due to the movement of the main slider from the extracted position to the retracted position, and vice versa, wherein the transmission mechanism comprises contact formations provided on the locking arm and on the main slider and cooperating with each other for imparting an oscillating movement to the locking arm following a rectilinear movement of the main slider; an electromagnetic switch comprising an electromagnet which drives a movable member associated with a locking pin arranged to lock the main slider in the retracted position;

a button movable independently of the main slider along the longitudinal rectilinear direction with respect to the main slider and an elastic element disposed between the button and the main slider, wherein the elastic element biases the button and the main slider in opposing directions; and an auxiliary slider movable along a direction transverse to the longitudinal rectilinear direction and connected to the main slider by a cam, the auxiliary slider cooperating with a door-sensing switch of the electromagnetic switch.

7. A door-locking device according to claim 6, wherein the elastic element is a helical spring in compression, wherein the helical spring is coaxial with a longitudinal rectilinear axis.

8. A door-locking device for an oven, comprising:

a main slider movable along a longitudinal rectilinear direction;

a button movable independently of the main slider along the longitudinal rectilinear direction with respect to the main slider and an elastic element disposed between the button and the main slider, wherein the elastic element biases the button and the main slider in opposing directions;

a locking arm configured to articulate around an articulation axis that is perpendicular to the longitudinal rectilinear direction;

a transmission mechanism that couples the locking arm to the main slider and arranged to swing the locking arm between an unlocked position and a locked position in response to movement of the main slider; and an electromagnetic switch including an electromagnet which drives a movable member associated with a locking pin arranged to lock the main slider in the retracted position.

9. A door-locking device according to claim 8, further comprising a support configured to be fixed to a frame of the oven.

10. A door-locking device according to claim 8, wherein the main slider is pushed elastically towards an extracted position and configured to be pushed by the door of the oven towards a retracted position.

11. A door-locking device according to claim 8, wherein the locking arm is configured to oscillate oscillating around the articulation axis between the unlocked position and the locked position.

12. A door-locking device according to claim 8, wherein the transmission mechanism comprises contact formations provided on the locking arm and on the main slider and cooperating with each other for imparting an oscillating movement to the locking arm following a rectilinear movement of the main slider.

13. A door-locking device according to claim 8, wherein the locking arm comprises one L-shaped end opposite to the articulation axis.

14. A door-locking device according to claim 8, further comprising an auxiliary slider movable along a direction transverse to the longitudinal rectilinear direction and connected to the main slider by a cam, the auxiliary slider cooperating with a door-sensing switch.

15. A door-locking device according to claim 8, wherein the elastic element is a helical spring in compression, wherein the helical spring is coaxial with a longitudinal rectilinear axis.

* * * * *